US005967042A

United States Patent [19]

Chiloff

[11] Patent Number: 5,967,042

[45] Date of Patent: Oct. 19, 1999

[54] DEVICE FOR INKING A PITTED CYLINDER

[75] Inventor: Serge Chiloff, Olivet, France

[73] Assignee: ATN, Olivet, France

[21] Appl. No.: 09/008,309

[22] Filed: Jan. 16, 1998

[30] Foreign Application Priority Data

Jan. 17, 1997 [FR] France ..... 97 00482

[51] Int. Cl.[6] ..... B41F 31/04; B41F 31/08

[52] U.S. Cl. ..... 101/350.6; 101/366

[58] Field of Search ..... 101/350.6, 366, 101/363, 350.1

[56] References Cited

U.S. PATENT DOCUMENTS

| | | | |
|---|---|---|---|
| 2,612,834 | 10/1952 | Sherman | 101/119 |
| 3,044,396 | 7/1962 | Aller | 101/157 |
| 4,958,561 | 9/1990 | Grosshauser et al. | 101/363 |
| 5,005,476 | 4/1991 | Kobler et al. | 101/363 |
| 5,121,689 | 6/1992 | Fadner | 101/366 |
| 5,226,364 | 7/1993 | Fadner | 101/366 |
| 5,367,982 | 11/1994 | DeMoore et al. | 101/350.6 |

FOREIGN PATENT DOCUMENTS

| | | |
|---|---|---|
| 0246708 | 11/1987 | European Pat. Off. . |
| 1246449 | 10/1960 | France . |

*Primary Examiner*—Edgar Burr
*Assistant Examiner*—Amanda B. Sandusky
*Attorney, Agent, or Firm*—Browdy and Neimark

[57] ABSTRACT

In a device for inking a pitted cylinder, and for ensuring a regular inking, a pressing roller is placed within a seal tight chamber formed between doctor blades provided for laminating ink within the seal tight chamber.

3 Claims, 2 Drawing Sheets

DEVICE FOR INKING A PITTED CYLINDER

FIELD OF THE INVENTION

This invention relates to a device for inking a pitted cylinder.

BACKGROUND OF THE INVENTION

Flexographic printing processes use more and more so called "anilox" pitted cylinders for ensuring a suitable distribution of ink.

The advantage of a pitted cylinder arrangement comparatively to other arrangements that use a rolling of two smooth cylinders for pressure dosing an amount of ink, is a far better regularity of the film of ink that is distributed, whatever is the printing speed.

This is mainly due to the constant volume formed by the pits in the cylinder.

A first improvement of the distribution arrangement by pitted cylinder has been obtained by adding a doctor blade which rigorously removes the excess of ink whatever is the speed, and this is done better than with an ordinary drying cylinder.

A second improvement has been obtained by mounting a second doctor blade in order to form a seal tight feeding chamber, with a circulation of pressurized ink, which results in:

1—suppressing any overflow of ink and consequently making the flexo-machine clean;

2—improving penetration of ink into the pits due to the pressure of ink within the chamber.

The known devices have however a defect comprising a printing of a phantom image.

The invention comes from the finding that the above mentioned problem can be explained as follows:

The pitted cylinder makes the ink contained in the pits to go out on the printing parts of the plate, thereby creating a negative image of the printed image.

The pits that have been drained of their ink become filled with air that enters the seal tight chamber.

This air must thus be expelled by the pressure of the ink circulating in the chamber and discharged with the excess of ink through the return opening.

Unfortunately it is found that the faster the cylinder rotates and the smaller the time for the pressure of ink to discharge the air contained in the pits, there is incomplete inking.

The ratio between the pitted arrangement and the plate carrying cylinder being generally different from 1:1, irregular printing results, including return of the image that has been previously printed. This drawback is known under the term of "ghosting", i.e. a phantom image.

Consequently, the purpose of the invention is to provide a better and faster discharge of air.

The prior art has disclosed an inking unit shown in U.S. Pat. No. 5,005,476 to Köbler and Ia. However this inking unit does not eleminate the above drawbacks.

SHORT SUMMARY OF THE INVENTION

According to the invention, the device for inking a pitted cylinder is characterized in that, for ensuring a regular inking, a pressing roller is placed within a seal tight chamber formed between doctor blades provided for laminating a pressurized ink within said seal tight chamber a housing being provided in the seal tight chamber for supporting the pressing roller, this pressing roller comprising a shaft that rotates in a bearing member sliding in the housing and is urged by a spring contained in the housing.

Various other features of the invention will be revealed from the following detailed description.

SHORT DESCRIPTION OF THE DRAWINGS

An embodiment of the invention is shown as a non limitative example in the accompanying drawings, wherein.

DETAILED DESCRIPTION OF THE PREFERRED EMBODIMENT

Figure 1:
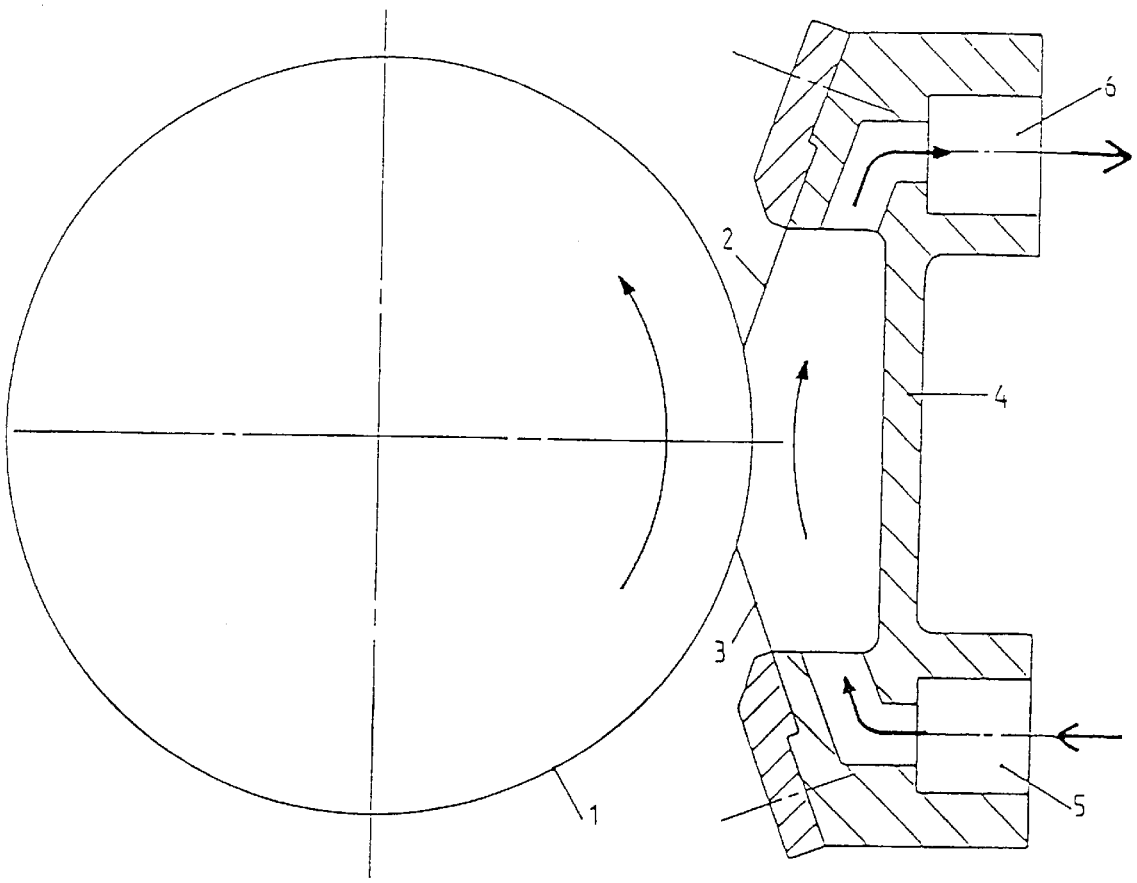
FIG. 1 (PRIOR ART)
FIG. 1 is a diagrammatic cross-sectional view of a known seal tight chamber for inking a convex pitted cylinder.

In the drawings, 1 is a so-called "anilox" pitted cylinder, 2 is an outlet doctor blade for removing an excess of ink, 3 is an inlet doctor blade for providing seal tightness, 4 is a body of a seal tight chamber in which comes an inlet opening 5 for a pressurized ink, and 6 is a return opening for the ink after passage in the seal tight chamber formed between the doctor blades 2 and 3.

Figure 2:
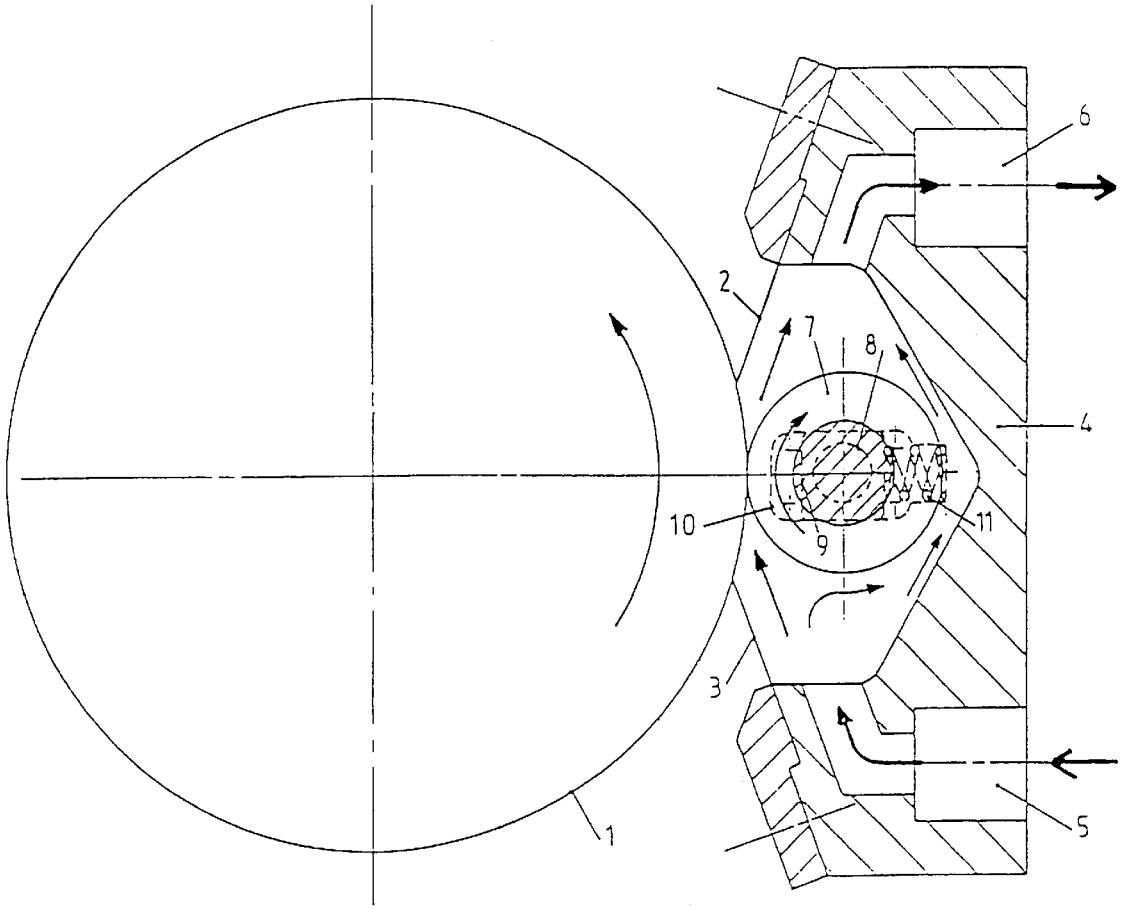
FIG. 2 is a diagrammatic cross-sectional view similar to FIG. 1 but showing a ink laminating device according to the invention.

As shown in FIG. 2, a pressing roller 7 is provided in the seal tight chamber. The roller 7 is coated with rubber and comprises a shaft 8 which rotates in a bearing member 9 that slides in a housing 10 in the seal tight chamber. The roller 7 is urged on the pitted cylinder 1 by a spring 11.

The ink coming with pressure in the seal tight chamber from the inlet opening 5 is introduced between the cylinder 1 and the roller 7, where the ink is laminated to form a thin film, thanks to pressure of the spring 11.

Laminated film is much thinner as the viscosity of the ink is small. Since a viscosity of the air that is contained in the ink is about 1000 times smaller than viscosity of the ink, this air is rejected practically in totality.

The excess of ink and the air as rejected are then discharged through the return opening 6.

The pits that have been cleared from the air contained therein are finally scrapped by the outlet doctor blade 2.

The invention is not restricted to the embodiment that has been shown and described in detail since various modifications thereof can be braught thereto without departing from the scope of the invention as shown in the following claims.

I claim:

1. A device for inking a pitted cylinder said device comprising a pressing roller (7) engaged entirely within a seal tight chamber formed between doctor blades (2, 3), said pressing roller laminating a pressurized ink within said seal tight chamber on said pitted cylinder, a housing (10) in said seal tight chamber supporting said pressing roller (7) therein, said pressing roller (7) comprising a shaft (8) that rotates in a bearing member (9) sliding in said housing (10) and urged by a spring (11) contained in said housing, wherein said roller is driven without mechanical connection outside said seal tight chamber.

2. A device as set forth in claim 1, wherein said pressing roller (7) is coated with rubber.

3. A device as set forth in claim 1, wherein said seal tight chamber (4) forms an inlet opening (5) for said pressurized ink driven between said cylinder (1) and said pressing roller (7).

* * * * *